United States Patent [19]

Csaszar

[11] Patent Number: 4,848,614

[45] Date of Patent: Jul. 18, 1989

[54] TAMPER-EVIDENT PLASTIC CLOSURE

[75] Inventor: Edward F. Csaszar, Mountainside, N.J.

[73] Assignee: General Kap Corporation, Bound Brook, N.J.

[21] Appl. No.: 120,617

[22] Filed: Nov. 13, 1987

[51] Int. Cl.[4] ..... B65D 41/34

[52] U.S. Cl. ..... 215/252; 220/268

[58] Field of Search ..... 215/252, 253, 258; 220/268

[56] References Cited

U.S. PATENT DOCUMENTS

| | | | |
|---|---|---|---|
| 4,478,343 | 10/1984 | Ostrowsky | 215/253 X |
| 4,657,153 | 4/1987 | Hayes | 215/252 |
| 4,700,859 | 10/1987 | Gregory | 215/252 |
| 4,732,289 | 3/1988 | Granat et al. | 215/252 |

*Primary Examiner*—Steven M. Pollard

*Attorney, Agent, or Firm*—Lerner, David, Littenberg, Krumholz & Mentlik

[57] ABSTRACT

Tamper-evident plastic closures are disclosed for use in connection with containers in which the closures include an internally threaded upper portion and a depending lower skirt portion with a number of frangible bridges connecting same. The depending lower skirt includes an inwardly projecting stop bead which can project upwardly from the inner surface of the skirt towards the lower surface of an annular collar on the container when the closure is completely threaded onto the container and to engage that lower surface when the closure is unscrewed from the container. The inwardly projecting stop bead is elongated and has a thickness along its entire length which is substantially thinner than the distance between the container finish surface below the annular collar and the inner surface of the skirt, and the inner surface of the skirt also includes a number of projections which urge the inwardly projecting stop bead towards the container finish surface to prevent removal of the closure without fracturing the bridges.

13 Claims, 2 Drawing Sheets

TAMPER-EVIDENT PLASTIC CLOSURE

FIELD OF THE INVENTION

The present invention is directed to tamper-evident plastic closures. More particularly, the present invention is directed to one-piece molded plastic closures, and particularly to such closures which can be threaded onto a container, and which include a tamper-indicating band joined to the bottom of the closure skirt by frangible means, such as a series of frangible bridges, which are fractured upon subsequent removal of the closure from the container.

BACKGROUND OF THE INVENTION

Since at least the early 1980's there has been a substantial increase in the need for simple and efficient tamper-evident plastic closures for application to the necks of various bottles and containers. This need has grown geometrically with the rash of tampering which has occurred in the market place in which foreign substances have been placed inside containers prior to purchase. There has thus been a very heavy demand for closures which can be used to visually identify those containers which have previously been opened, so that the consumer will be forewarned against purchasing such products.

In response to this extremely high demand an extremely large number of such tamper-evident plastic closures have been developed. One of the most significant developments in the field of tamper-evident plastic closures is exemplified by U.S Pat. Nos. 4,343,408 and 4,461,390, which relate to a highly successful such closure which has been adopted for use in various commercial environments. These patents, which are assigned to the assignee of the present application, include such a closure which has a depending lower skirt portion as well as an intermediate side wall portion thereabove, and which further includes an inwardly projecting bead on the inside surface of the depending lower skirt portion which is adapted to engage the lower end of an annular collar portion of the container to which the closure is to be applied. A frangible portion, such as a plurality of frangible bridge members, is located along the inner surface of the cylindrical side wall, and the side wall portions both above and below these bridges are substantially in alignment with each other, and preferably also have substantially uniform thicknesses. This permits the thin and flexible bridges to flex and bend during application of the closure onto the container without breaking. This, in turn, is facilitated by the wall portions above and below the frangible portions coming together or contacting each other so as to bear the load during application, again to prevent premature fracture of these bridges. Furthermore, upon the subsequent removal of these closures the same bridges are easily broken, and the depending lower skirt portion of the closure remains on the container after the upper portion of the closure has been removed therefrom. Improvements in this device such as that in U.S. Pat. No. 4,461,390, have also included portions of the upper and lower wall above and below the bridges being parallel to each other to further facilitate acceptance of the load thereacross.

Another prior tamper-evident closure is disclosed in U.S. Pat. No. 4,613,052. In this patent the inwardly projecting bead of the devices shown in the patents discussed above are described as an annular stop ring

20, which when the cap is initially formed takes the configuration shown in FIG. 2 of the '052 patent. Furthermore, when this stop ring is inverted, it can extend inwardly and upwardly relative to the indicator band 15 or lower depending skirt portion of the closure, in the manner shown in FIGS. 3 and 5–7 of this patent. As this patentee specifies, the stop ring 20 has a free end 21 which is somewhat thicker than the thickness of the connection between the ring and band 15. As can best be seen in FIG. 6 of the '052 patent, after the closure has been applied to a container, stop ring 20 is positioned with the upper free end 21 of the stop ring 20 in engagement with the tapered surface 29 of the container finish, and also in close proximity to the bridge 16. In this manner, when the closure is removed, stop ring 20 cannot pass over the bead 26, and the bridges thus fracture.

The overall closure shown in the '052 patent, however, does not fully and consistently perform the function for which it was primarily designed. That is, it is most important that these closures can be easily applied to the container without premature fracture. However, in the past the problem has continued to arise that when this is accomplished on a consistent basis, it then becomes more difficult to consistently insure that upon removal of these closures fracture occurs in every case, since if this does not happen then the basic purpose of these closures will not be realized. The search has therefore continued for improved tamper-evident closures of this general nature, which are not only less expensive, but which, most importantly, have greater reliability, so that the closure can be easily applied to the containers while the avowed purpose of tamper-evidence is still realized in essentially every case.

SUMMARY OF THE INVENTION

In accordance with the present invention, these and other objects have now been realized by the invention of a temper-evident plastic closure intended to be used in connection with a container having a threaded neck portion, an annular collar portion below the threaded neck portion, and a container finish surface below the annular collar portion, and in which the closure itself comprises a one-piece plastic closure body including an end wall and a cylindrical side wall, the cylindrical side wall including an internally threaded upper portion, a depending lower skirt portion, and a frangible portion therebetween, the depending lower skirt portion including an inwardly projecting stop bead which is adapted to project upwardly from the inner surface of the depending lower skirt portion of the closure towards the lower surface of the annular collar portion of the container when the closure is completely threaded onto the container, and to engage the lower surface of the annular collar portion of the container when the closure is unscrewed from the container, the inwardly projecting stop bead being elongated and having a thickness along its entire length such that it is substantially thinner than the distance between the container flange surface and the inner surface of the depending lower skirt portion of the closure, the annular collar portion of the container also including urging means for urging the inwardly projecting stop bead towards the container finish surface when the closure is completely threaded onto the container so as to prevent the removal of the closure from the container without fracturing the frangible portion of the closure to insure that the depending lower skirt portion of the closure remains on the container upon removal of the internally threaded upper portion of the closure therefrom.

In accordance with one embodiment of the tamper-evident closure of the present invention, the urging means has a maximum height which is insufficient to cause the inwardly projecting stop bead to span the distance between the urging means and the container finish surface so as to avoid contact between the container finish surface and the stop bead when the closure has been completely threaded onto the container.

In accordance with another embodiment of the tamper-evident closure of the present invention, the urging means comprises a plurality of projection members located circumferentially around the inner surface of the depending lower skirt portion of the closure. In a preferred embodiment, the frangible portion of the closure comprises a plurality of frangible bridge members located circumferentially around the closure.

In accordance with another embodiment of the tamper-evident closure of the present invention, the inwardly projecting stop bead is hingedly connected to the inner surface of the depending skirt portion of the closure so that the inwardly projecting stop bead can swing between an upwardly projecting position directed towards the lower surface of the annular collar portion of the container and a downwardly projecting position directed below the depending lower skirt portion. In a preferred embodiment, the urging means comprises a plurality of projection members located circumferentially around the inner surface of the depending lower skirt portion of the closure. Preferably, the number of these projection members corresponds to the number of frangible bridge members. In a highly preferred embodiment each of the projection means is located adjacent to each of the corresponding frangible bridge members, and most preferably eight of the projection members and corresponding frangible bridges are provided.

In accordance with another embodiment of the tamper-evident closure of the present invention, the frangible portion divides the intermediate side wall portion into an upper intermediate side wall portion and a lower intermediate side wall portion above and below the frangible portion, respectively, and at least a portion of the upper and lower intermediate side wall portions include juxtaposed parallel surfaces to maintain the upper and lower intermediate side wall portions in alignment with each other upon the collapse of the frangible portion. In a preferred embodiment, the at least a portion of the upper and lower intermediate side wall portions comprises a plurality of juxtaposed parallel surfaces, and most preferably the frangible portion comprises a plurality of frangible bridge members located circumferentially around the closure. In a preferred embodiment the parallel surfaces alternate with the frangible bridge members. Again, most preferably eight of the juxtaposed parallel surfaces and eight of the frangible bridge members are provided.

In accordance with a preferred embodiment of the tamper-evident closure of the present invention the plurality of frangible bridge members are located along the inner wall surface of the cylindrical side wall of the closure. Preferably, the bridges are sufficiently thin and flexible and have sufficient length so as to be capable of collapsing when the inwardly projecting stop bead passes over the annular collar portion of the container as the closure is being threaded onto the container to thus permit the upper and lower side wall portions to abut against each other and thereby permit the closure to be applied to the container without fracturing the frangible bridge members.

BRIEF DESCRIPTION OF THE DRAWINGS

In connection with the detailed description which follows, this can be more easily understood with reference to the Figures, in which.

DETAILED DESCRIPTION

Figure 1:
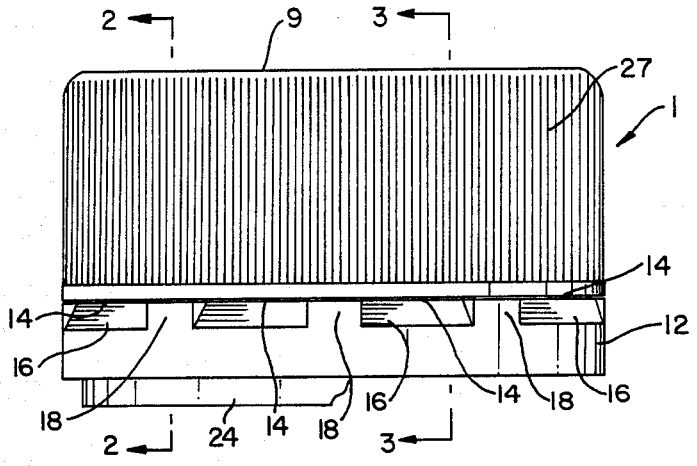
FIG. 1 is a side, elevational, partially broken away view of a tamper-evident plastic closure in accordance with the present invention.

Referring to the Figures, in which like numerals refer to like portions thereof, FIG. 1 shows a tamper-evident plastic closure in accordance with this invention. The closure itself is preferably produced from thermoplastic material, and is adapted to be threaded onto the neck of a corresponding container. A portion of the container itself can thus be seen in FIGS. 4–6, and the neck of the container thus includes a threaded neck portion 3, an annular collar portion 5 below the threaded neck portion 3, and providing an annular collar on the outer surface of the container, and a container finish surface 7 located below the annular collar portion 5 of the container. As will be discussed in more detail below, when the tamper-evident plastic closures of the present invention are fully threaded onto a container, they are designed so that the lower skirt portion of the closure will be juxtaposed with this container finish surface of the container itself.

In any event, it is the annular collar portion 5 of the container which will provide the means by which the tamper-evident plastic closure itself will be firmly engaged or affixed both before and after fracture of the tamper-evident portion of the closure. Indeed, it is this portion of the container which assists in the fracturing process itself.

Returning to FIG. 1, the closure 1 includes an upper end wall 9 and an internally threaded upper portion 11, which is intended to correspond to the threaded neck portion 5 of the container to which it is to be applied. A portion of the closure 1 which is affixed to the collar or bead 7 when the closure is completely threaded onto the container 1 includes a depending lower skirt portion 12. This depending lower skirt portion 12 is generally cylindrical in shape and has essentially the same external diameter as the outer surface of the internally threaded upper portion 11 of the closure 1. As can best be seen in FIG. 3, the internally threaded upper portion 11 is connected to the depending lower skirt portion 12 by frangible bridge members 14, and preferably eight of these individual frangible bridges are located circumferentially around the closure, on the inner surface thereof, as is again shown in FIG. 3. The thickness of these bridges is generally from about 0.003 to 0.015 inches, and preferably from about 0.006 to 0.010 inches, and most preferably between about 0.007 and 0.009 inches, such as 0.008 inches. These individual bridges 14 are thus sufficiently thin and flexible and have sufficient length so that as the closure is being applied to the container and is passing over the annular collar portion 5 of the container, the bridges 14 can collapse, and as will be discussed in more detail below, the side wall portions of the closure above and below the bridges 14 can come into contact or abutment with each other and thus transfer the force between these portions and protect the bridges 14 from premature fracture.

Figure 2:
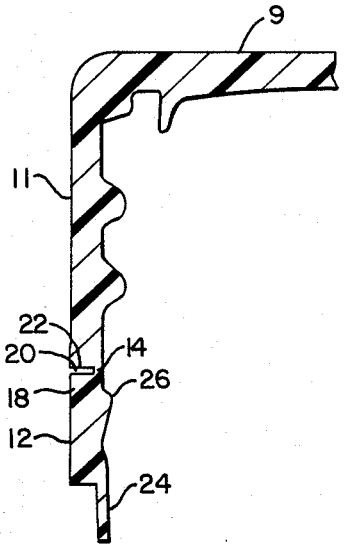
FIG. 2 is a side, elevational, partial sectional view of the tamper-evident plastic closure of FIG. 1 taken along lines 2—2 thereof.

As can best be seen in FIGS. 1 and 2, the upper portion of the depending lower skirt portion 12 of the closure includes a generally tapered surface 16 which, however, is intermittently interrupted by support members 18. These support member 18 have an upper surface 20 which can thus be disposed in parallel to the lower surface 22 of the lower portion of the wall of the container extending from the internally threaded upper portion 11 thereof. These two surfaces, which are in alignment with each other, maintain their condition when the bridges 14 collapse, and thus bear the brunt of the pressures created during the application of the closure and prevent such pressures from being transferred directly to the bridges to prematurely fracture them.

Referring again to FIGS. 2 and 3, the inner surface of the depending lower skirt portion 12 of the container includes an inwardly projecting stop bead 24. This integrally formed stop bead 24, upon initial formation of the tamper-evident plastic closure of the present invention, will take the configuration shown in FIG. 2 hereof. Thus, the as-molded position of the stop bead 24 will be facing downwardly and inwardly in the configuration of the closure as shown in FIG. 2, and immediately after molding the stop bead 24 is then pushed through an angle of less than about 180°, from that "as molded" to the inverted position shown in FIG. 3. In this configuration the stop bead 24 can now perform precisely the same function as that of the inwardly projecting beads in the prior art, such as in U.S. Pat. Nos. 4,343,408 and 4,461,390 discussed above. This inversion can take place in a number of ways, including rotation of the closure about its vertical axis parallel to the skirt portion while the stop bead 24 is engaged by a beveled rotating wheel, which is not shown in the drawings. This technique is specifically described in U.S. Pat. No. 4,613,052, which disclosure is incorporated herein by reference thereto.

The inwardly projecting stop bead 24 is required to be uniformly thin along its length. More particularly, and as can best be seen in FIGS. 4 and 5, the stop bead 24 is itself thinner than the distance between the inner wall of the depending lower skirt portion 12 and the outer wall of the container finish surface 7 of the container. It thus cannot span the distance between those two surfaces, and leaves a space therebetween.

Figure 3:
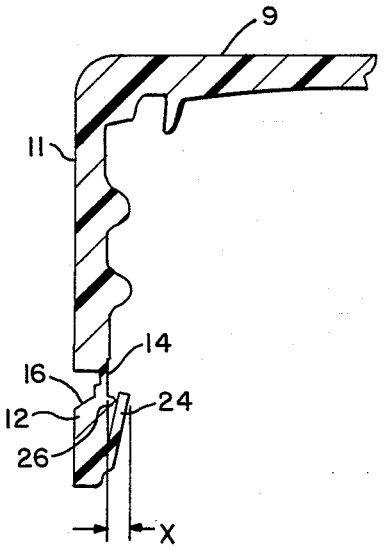
FIG. 3 is a side, elevational, partial sectional view of the tamper-evident plastic closure of FIG. 1 taken along lines 3—3 thereof.
Figure 4:
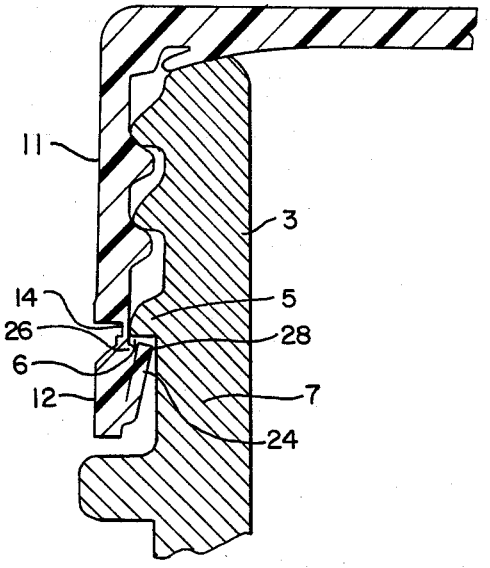
FIG. 4 is a side, elevational, partial sectional view of the tamper-evident plastic closure of FIG. 1 in connection with a portion of a container to which the closure is applied.

In order to urge the inwardly projecting stop bead 24 towards the outer surface of the container finish surface 7, but still without spanning that distance, along the inner surface of the depending lower skirt portion 12 are provided a number of projections 26. These projections 26 are preferably individual projections or "bumps" located in spaced positions circumferentially around the inner surface of the depending lower skirt portion 12 of the closure 1. Thus, when the inwardly projecting stop bead 24 is in its upward position as shown in FIGS. 3 and 4, these projections 26 tend to urge the stop bead 24 towards the outer surface of the container finish surface 7, again however, without spanning that distance, and thus again leaving a space 28, as can best be seen in FIG. 4 therebetween. It is crucial to the present invention that this space be provided for in this manner. Furthermore, between the individual projections 26 the inner wall of the depending lower skirt portion 12 is flat, and is devoid of such projections. It therefore does not tend to urge the stop bead 24 towards the outer wall of the container finish surface 7 of the container itself at these locations intermediate the projections 26, thus tending to increase the distance 28 therebetween.

In this manner it is possible to produce a thin and uniformly dimensioned inwardly projecting stop bead 24 which can perform the precise functions of the inwardly projecting beads in the prior art patents discussed above, but now in a far simpler, less expensive and more efficient manner. More specifically, this structure now permits relatively easy application of the closures hereof to the containers, i.e., without premature fracture of the frangible portions, or bridges 14, and at the same time essentially guarantee that, after such application, removal of these closures from the container will result in complete and uniform fracture of these bridges 14, so that upon removal of the upper portion 11 of the closure the depending lower skirt portion 12 thereof remains on the container to evidence the fact that the container has been opened, i.e., to perform the primary function for which these closures have been developed. The significance of the present closures, being able to improve the degree of uniformity with which this function can now be carried out is not insubstantial. Many prior techniques have been utilized in order to improve upon such reliability of these types of closures, and at the same time permit easy application of these closures without premature fracture taking place.

This latter problem generally results from the degree of friction which takes place between the inwardly projecting bead and the closure and the annular collar portion of the container as the closure is being applied, and the depending lower skirt must therefore expand thereover. Again, that degree of friction will increase, thus exacerbating this problem, as one reduces the inner diameter of the inwardly projecting bead so as to insure uniform fracture upon removal.

Therefore, prior techniques to overcome this problem, without great success, have included the application of lubricants during the capping process, the application of heat, slower capping speeds, and other such complicated and expense-creating methods.

In accordance with the present invention, however, this can now occur by reducing the contact area as between the inwardly projecting stop bead 24 and the annular collar portion 5 of the container. This, in turn, reduces the overall surface friction therebetween which arises during application of the closure, or the capping operation. Thus, the inwardly projecting stop bead 24 is, as discussed above, thinner than the distance between the inner wall of the depending lower skirt portion 12 and the outer wall of the container finish surface 7. The projections 26 therefore act to push the inwardly projecting stop bead 24 inwardly at separated points along its length. This, in turn, results in what essentially amounts to point contact at the locations corresponding to the locations of each of these projections 26, but with reduced friction maintained therebetween. This configuration thus permits one to simultaneously achieve both of the above-mentioned desired results, namely reduced friction, and thus a reduced torque requirement, during application of the closure to the container, or the capping procedure, and at the same time provide for essentially universal fracture upon removal of the closure by application of the continuous annular stop bead 24 against the lower surface of the annular collar portion 5. Indeed, the projections 26 further insure the latter by projecting or pushing the stop bead 24 inwardly so that essentially the entire surface thereof effectively contacts that lower surface to insure fracture upon removal.

Referring again to FIG. 1, the outer surface of the closure 1 can be seen, and includes an area containing a plurality of vertical serrations 27 forming a linear-roughened surface thereon. This surface has been found to be not only aesthetically appealing, but also aids in assisting one to grip the closure and twist it in order to effect fracture and removal of the internally fitted upper portion 11 of the closure 1.

As noted above, the closure 1 of the present invention is preferably made of thermoplastic material, and can be manufactured in an injection molding process. After the part has been molded, during opening of the mold, the closure would be removed from the mold by a stripping process which is well known in this field. In such a process, a stripper plate, which is part of the mold itself, ejects the finished closure from the mold. As the mold initially opens, the closure is released from an undercut position in the mold by means of angle pins which cause cam bars to separate from around the closure. The undercut position was created because protruding portions of the mold (cams) were required in order to mold the annular groove, i.e., the weak portion of the closure which is intended to fracture. The remainder of the molding process is the same as in conventional thermoplastic molding processes. However, this above-described molding process, while preferred for use in connection with the molding of the closures of the present application, differs slightly from the preferred procedures described in prior patents such as the above-noted U.S. Pat. Nos. 4,343,408 and 4,461,390. In these procedures, the internal threads of the closure are formed by the action of an unscrewing mold. Therefore, after molding, and during opening of the mold, the cores of the mold rotate and unscrew from the closure, thus forming these threads. Furthermore, during this unscrewing phase the closure itself is kept from turning by means of steel teeth, which engage the bottom of the closure and hold it in place as the core rotates. In the presently preferred molding procedure, however, this "unscrewing" procedure is not utilized, and the threads are formed directly during the molding stage, after which the finished closure is merely "stripped" from the mold as discussed above. While this procedure has its advantages, it will be appreciated that under normal circumstances the use of such a procedure will limit the "degree of undercut," or, that is, the distance which the inwardly projecting bead can project from the inner wall of the depending lower skirt portion of the closure, such as in the case of the inwardly projecting beads used in the aforementioned '408 and '390 patents. In particular, it has been found that utilizing such a stripping procedure generally means that an undercut of about 0.050 inches is about the most that can be obtained while still being able to "strip" the closure from the mold without damaging or destroying the closure itself. Although this amount of undercut permits one to nevertheless produce a commercial closure in accordance with the '408 and '390 patents, even if such a stripping procedure is employed, by utilizing a closure in accordance with the present invention it is now possible to produce a closure with an undercut of greater than 0.050 inches while still utilizing the above-described stripping procedure. Thus, it is now possible to mold the closure with the inwardly projecting stop bead 24 in the downward position shown in FIG. 2, and then subsequently inverting the stop bead 24 after removal or stripping from the mold into the position shown in FIG. 3 so that it now has an undercut which is preferably 0.060 inches or greater, which is represented by dimension x in FIG. 3. Furthermore, by using this procedure it is also possible to produce such a stop bead 24 which has a sharp end portion, which lends further assistance in preventing removal of the depending lower skirt portion of the closure from the container by the stop bead 24 sliding over the annular collar 5 on the container. Again, this can be contrasted to prior inwardly projecting beads which, particularly if produced by a stripping procedure, required a smooth upper surface in order to facilitate such stripping from the mold without damage. This results in a surface, however, which can on occasion slip over the annular collar portion of the container after the closure has been applied thereto. This potential problem is therefore also avoided in accordance with the closures of the present invention.

Figure 5:
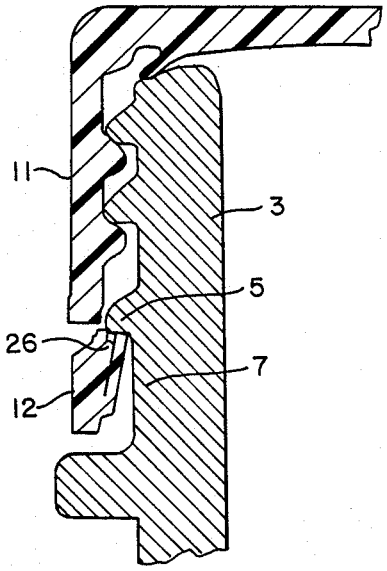
FIG. 5 is a side, elevational, partial sectional view of the tamper-evident plastic closure of FIG. 4 immediately after fracture of the bridge members upon removal of the closure from the container.
Figure 6:
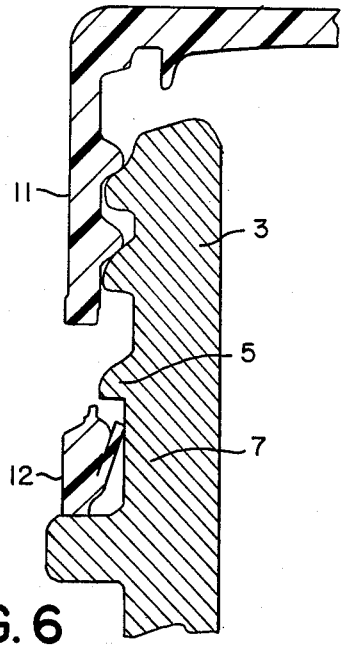
FIG. 6 is a side, elevational, partial sectional view of the tamper-evident plastic closure of FIG. 5 further subsequent to removal of the upper portion of the closure therefrom.

Referring next to FIGS. 4–6, the sequence which occurs during removal of the closure from the container and fracture of the bridges 14 can be more readily observed.

More particularly, in FIG. 4 the closure is completely threaded onto the container so that the inwardly projecting stop bead 24 in its upward position is spaced from the outer wall of the container finish surface 7 of the container by space 28, and is located beneath the lower surface 6 of the annular collar portion 5 of the container. As one begins to unscrew the upper portion 11 of the closure 1 from the container, the end of the inwardly projecting stop bead 24 comes into contact with the lower surface 6 of the annular collar portion 5 of the container, and further unscrewing causes the bridges 14 to fracture as shown in FIG. 5. Thus, even though the inwardly projecting stop bead 24 is spaced from the outer wall of the container finish surface 7 of the container by space 28, by means of the presence of projections 26 on the inner surface of the depending lower skirt portion on 12 of the container urging the inwardly projecting stop bed 24 towards that outer wall of the container finish surface 7, it is assured that the container, along with the depending lower skirt portion 12, cannot be removed from the container without fracturing the bridges 14. When this occurs, however, as is more fully shown in FIG. 6, the annular skirt portion 12 has now been completely separated from the upper portion 11 of the container 1, and the upper portion 11 can now be removed completely from the container to provide access thereinto. At the same time the annular skirt portion 12 can now fall freely below the annular collar portion 5 and remain affixed to the container at that point. This, of course, provides the tamper evidence to which the present invention is specifically directed.

The closure of the present invention can also be adapted to be used with a variety of containers and bottles, i.e., where, for example, the annular collar or bead on the bottle has different dimensions from that shown in the drawings, or is located at different positions relative to the end of the neck of the bottle. Various such embodiments are shown in the prior art, such as in U.S. Pat. Nos. 4,343,408 and 4,461,390, and one of ordinary skill in this art would clearly adapt the tamper-evident plastic closures of the present invention to such various bottle or container configurations.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A tamper-evident plastic closure for use in connection with a container having a threaded neck portion, an annular collar portion below said threaded neck portion, said annular collar portion including an upper surface and a lower surface, and a container finish surface below said annular collar portion, said closure comprising a one-piece plastic closure body including an end wall and a cylindrical side wall, said cylindrical side wall including an internally threaded upper portion, a depending lower skirt portion, and a frangible portion therebetween, said depending lower skirt portion including an inwardly projecting stop bead adapted to project upwardly from the inner surface of said depending lower skirt portion of said closure towards said lower surface of said annular collar portion of said container when said closure is completely threaded onto said container and to engage said lower surface of said annular collar portion of said container when said closure is unscrewed from said container, said inwardly projecting stop bead being hingedly connected to said inner surface of said depending lower skirt portion of said closure whereby said inwardly projecting stop bead can swing between an outwardly projecting position directed towards said lower surface of said annular collar portion of said container and a downwardly projecting position directed below said depending lower skirt portion, and being elongated and having a thickness along its entire length such that it is substantially thinner than the distance between said container finish surface and said inner surface of said depending lower skirt portion of said closure, said depending lower skirt portion of said closure also including a plurality of projection members located circumferentially around said inner surface of said depending lower skirt portion of said closure, which projection members are in constant contact with said inwardly projecting stop bead when said stop bead is in said outwardly projecting position, so that said stop bead is directed towards said container finish surface when said closure is completely threaded onto said container so as to prevent the removal of said closure from said container without fracturing said frangible portion of said closure so as to insure that said depending lower skirt portion of said closure remains on said container upon removal of said internally threaded upper portion of said closure therefrom.

2. The tamper-evident closure of claim 1, said projection members having a maximum height which is insufficient to cause said inwardly projecting stop bead to span said distance between said projection members and said container finish surface so as to contact said container finish surface when said closure has been completely threaded onto said container.

3. The tamper-evident closure of claim 1 wherein said frangible portion of said closure comprises a plurality of frangible bridge members located circumferentially around said closure.

4. The tamper-evident closure of claim 3 wherein the number of said plurality of projection members corresponds to the number of said plurality of frangible bridge members.

5. The tamper-evident closure of claim 4 wherein each of said plurality of projection members is located adjacent to each of said corresponding plurality of frangible bridge members.

6. The tamper-evident closure of claim 5 comprising eight of said projection members and said corresponding frangible bridge members.

7. The tamper-evident closure of claim 1 or 5 wherein said frangible portion divides said intermediate side wall portion into an upper intermediate side wall portion and a lower intermediate side wall portion above and below said frangible portion, respectively, and wherein at least a portion of said upper and lower intermediate side wall portions include juxtaposed parallel surfaces to maintain said upper and lower intermediate side wall portions in alignment with each other upon the collapse of said frangible portion.

8. The tamper-evident closure of claim 7 wherein said at least a portion of said upper and lower intermediate side wall portions comprise a plurality of juxtaposed parallel surfaces.

9. The tamper-evident closure of claim 8 wherein said frangible portion of said closure comprises a plurality of frangible bridge members located circumferentially around said closure.

10. The tamper-evident closure of claim 9 wherein said plurality of juxtaposed parallel surfaces alternate with said plurality of frangible bridge members.

11. The tamper-evident closure of claim 10 comprising eight of said juxtaposed parallel surfaces and said frangible bridge members.

12. The tamper-evident closure of claim 9 wherein said plurality of frangible bridge members are located along the inner wall surface of said cylindrical side wall portion of said closure.

13. The tamper-evident closure of claim 12 wherein said plurality of frangible bridge members are sufficiently thin and flexible and have sufficient length so as to be capable of collapsing when said inwardly projecting stop bead passes over said annular collar portion of said container as said closure is being threaded onto said container to thereby permit said upper and lower side wall portions to abut against each other and thereby permit said closure to be applied to said container without fracturing said frangible bridge members.

* * * * *